US007614725B2

(12) United States Patent
Schulmeister

(10) Patent No.: US 7,614,725 B2
(45) Date of Patent: Nov. 10, 2009

(54) INKJET PRINTING APPARATUS

(75) Inventor: Peter Schulmeister, Pfaffenhofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 502 days.

(21) Appl. No.: 11/639,895

(22) Filed: Dec. 15, 2006

(65) Prior Publication Data

US 2007/0139468 A1 Jun. 21, 2007

(30) Foreign Application Priority Data

Dec. 16, 2005 (DE) ..... 10 2005 060 786

(51) Int. Cl.
*B41J 2/05* (2006.01)

(52) U.S. Cl. ..... 347/57; 347/58

(58) Field of Classification Search ..... 347/12, 347/20, 40, 42, 49, 50, 56–59, 66, 84–87, 347/89, 92, 94

See application file for complete search history.

(56) References Cited

U.S. PATENT DOCUMENTS 5,969,729 A * 10/1999 Erickson et al. ..... 347/9
6,471,335 B1 10/2002 Gelbart
2002/0018097 A1 2/2002 Kitahara et al.
2003/0184613 A1 10/2003 Nakamura et al.
2004/0252161 A1 12/2004 Bibl et al.
2005/0168503 A1 8/2005 Mitsuzawa

FOREIGN PATENT DOCUMENTS

EP 1 479 520 11/2004
JP 2005/342982 12/2005
WO WO 2005/102708 11/2005

OTHER PUBLICATIONS

Search Report dated Dec. 16, 2005 issued for the corresponding German Application No. 10 2005 060 786.1.

* cited by examiner

*Primary Examiner*—Juanita D Stephens
(74) *Attorney, Agent, or Firm*—Cohen Pontani Lieberman & Pavane LLP

(57) ABSTRACT

An inkjet printing apparatus includes an array of inkjet print heads, wherein each print head has at least one ink port for receiving ink, at least one nozzle for directing ink onto a substrate to be printed, and at least one control terminal for receiving a supply voltage and/or control signals. A print head mounting element positions the print heads in a defined orientation relative to each other. An electrical supply unit extending over the array is connected to the control terminals of all of the print heads, and can supply a supply voltage and/or print head specific control signals to all of the print heads in common. A mechanical supply unit extending over the array is connected to the ink ports of all of the print heads, and can supply ink to all of the print heads in common.

14 Claims, 6 Drawing Sheets

INKJET PRINTING APPARATUS

BACKGROUND OF THE INVENTION

1. Field of the Invention

The invention pertains to an inkjet printing apparatus having an array of inkjet print heads, wherein each print head has at least one ink port for receiving ink, at least one nozzle for directing ink onto a substrate to be printed, and at least one control terminal for receiving a supply voltage and/or control signals, and wherein a print head mounting element positions the print heads in a defined orientation relative to each other.

2. Description of the Related Art

In printing presses which operate according to the offset printing principle, especially web-fed rotary presses and sheet-fed presses, increasing use is being made of inkjet printing devices primarily for the purpose of individualizing the printed materials produced by offset printing by adding to them, for example, barcodes, numbering, or other types of labeling. These inkjet printing devices have at least one inkjet print head, which can be designed according to the so-called "continuous" inkjet principle, the drop-on-demand inkjet principle, the thermal inkjet principle, the bubble inkjet principle, or any of the other inkjet principles. The inkjet print heads usually have a row of nozzles consisting of several adjacent ink nozzles, through which the ink can be directed onto the substrate to be printed.

In many applications of inkjet printing devices, it is necessary to use a large number of inkjet print heads, some arranged transversely to the transport direction of the printing stock, i.e., transversely to the printing direction, and others arranged in the printing direction. The required number of inkjet print heads transverse to the printing direction is defined primarily by the desired print resolution in relation to the given print resolution of the selected inkjet print head and by the desired overall printing width relative to the printing width of an inkjet print head. The required number of inkjet print heads in the printing direction is determined primarily by two factors: first, the fact that the desired printing speed is greater than the given printing speed of an inkjet print head, and, second, the fact that several different printing inks are to be applied to the substrate by the inkjet printing device.

In this type of inkjet printing apparatus with a plurality of inkjet print heads, the inkjet print heads are arranged in an array-like or matrix-like manner, where, to increase the print resolution transversely to the printing direction, the inkjet print heads of an inkjet printing device can be oriented at a slant to the transport direction of the stock and thus to the printing direction. The result is that the effective distance between the nozzles transverse to the printing direction or transport direction of the substrate is reduced, which means that the print resolution can be increased.

The inkjet print heads of these matrix-like or array-like inkjet printing devices have not only the previously mentioned ink nozzles, through which printing ink can be directed onto the substrate to be printed by the inkjet print heads, but also at least one ink port and at least one control terminal. Printing ink can be supplied to the inkjet print head in question through the ink port or through each ink port, whereas a supply voltage and control signals for actuating the ink nozzles of the print head can be sent to the inkjet print head in question via the control terminal or each control terminal. In the case of the inkjet printing devices known from conventional practice, i.e., devices which have a plurality of inkjet print heads arranged in an array-like or matrix-like manner, all of the inkjet print heads are supplied individually with ink and with supply voltage and control signals. For this purpose, separate supply lines are laid from an ink reservoir and from a control device and voltage supply source to each of the individual inkjet print heads. In cases where the inkjet printing device has a large number of inkjet print heads, it quickly becomes a very complicated matter to manage and organize all these individual supply lines. It therefore also becomes difficult to manage the overall inkjet printing device, which is disadvantageous especially when it is necessary to perform service and maintenance work. The reliability of these types of inkjet printing devices is also limited by this complexity.

SUMMARY OF THE INVENTION

The inkjet printing apparatus according to the invention includes at least:

(a) an electrical or electronic supply unit, which extends over the area of all the inkjet print heads, to which the individual control terminals of all the inkjet print heads are connected, and via which a supply voltage and/or print head-specific control signals can be sent to all of the inkjet print heads in common; and (b) a mechanical supply unit, which extends over the area of all the inkjet print heads, to which the individual ink ports of all the inkjet print heads are connected, and via which all of the inkjet print heads can be supplied with ink in common.

In accordance with the present invention, an inkjet printing apparatus has both an electrical or electronic supply unit in common for all of the inkjet print heads to provide the inkjet print heads with supply voltage and control signals and a mechanical supply unit in common for all the inkjet print heads to supply all of the inkjet print heads with ink. Thus, in the simplest case, only a single supply line must run from an ink reservoir to the mechanical supply unit and only a single line must run from a control device and voltage supply source to the electrical or electronic supply unit. This simplifies the management of inkjet printing devices with a plurality of inkjet print heads positioned with respect to each other in an array-like or matrix-like manner. Maintenance work or service procedures can be conducted with less effort, and the reliability of these inkjet printing devices is also increased.

According to an embodiment of the invention, the electrical or electronic supply unit is designed in modular fashion and includes a separate control card for each inkjet print head. The control card of each inkjet print head is connected to the control terminal of the inkjet print head in question, and the control cards of adjacent inkjet print heads are connected to each other. The control cards of adjacent inkjet print heads are connected to each other by flexible pin-and-socket connectors to form a bus structure, where a supply voltage to be transmitted and/or print head-specific control signals to be transmitted can be tapped on all sides of the control cards.

According to another embodiment of the invention, the mechanical supply unit is designed as an ink container, which has ink openings, where the inkjet print heads are connected by their ink ports via flexible connecting pieces to the ink openings of the ink container, and where each of these ink openings of the ink container has a valve, which opens and closes each of the individual ink openings independently. Ink can be supplied from the ink container to the inkjet print heads by gravity or by the use a circulating ink supply system.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
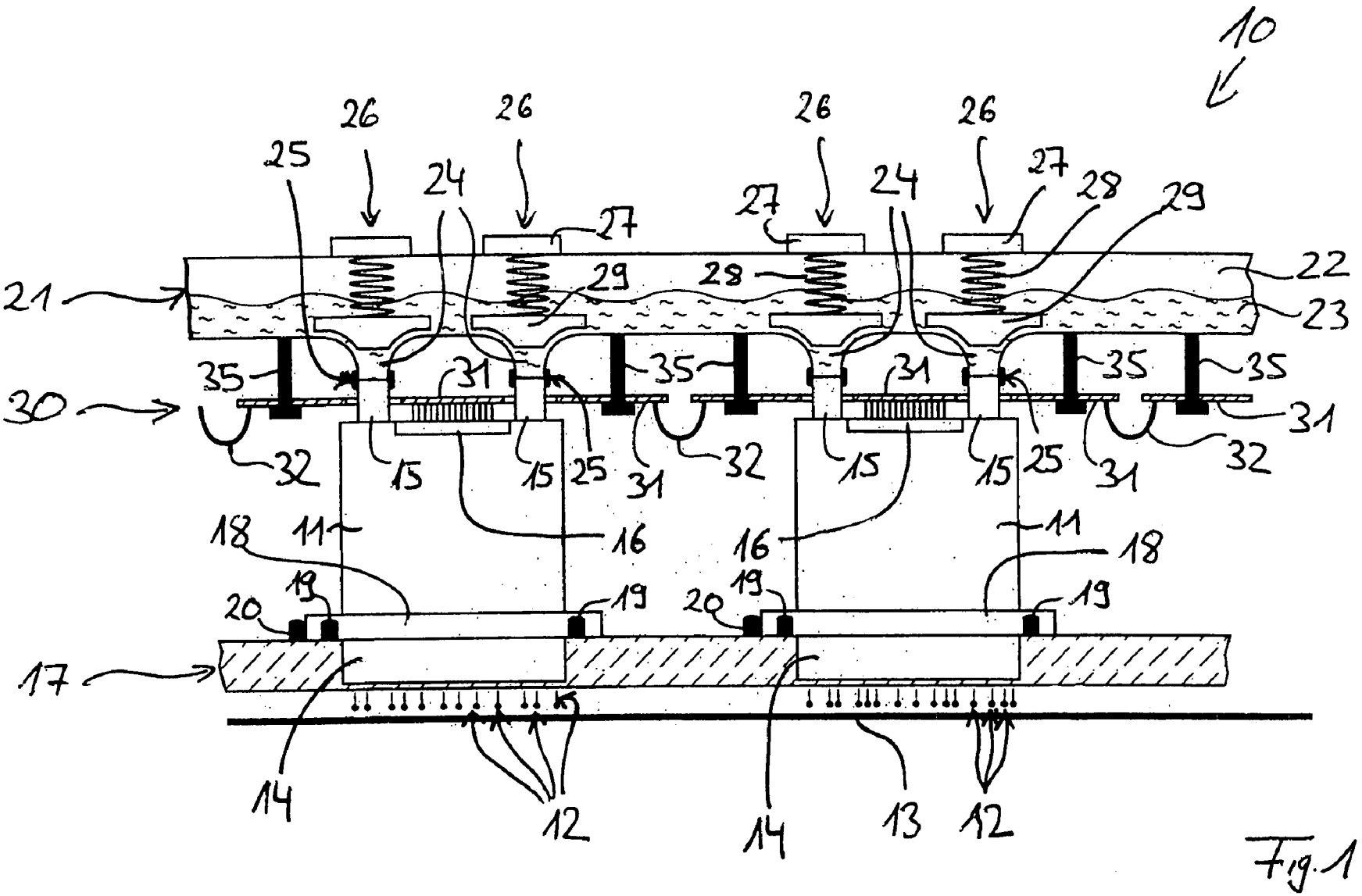
FIG. 1 shows a partial cross section through an inventive inkjet printing apparatus.

FIG. 1 shows a partial cross section through an inventive inkjet printing apparatus 10, which is used preferably in the area of offset printing presses such as web-fed rotary presses or sheet-fed rotary presses to individualize the printed products. The inventive inkjet printing apparatus 10 has a plurality of inkjet print heads 11, which are arranged next to each other and behind each other to form a matrix or array. The number of inkjet print heads 11 arranged behind each other and next to each other in an array-like or matrix-like manner is an almost completely free choice. The number of inkjet print heads shown in the following figures is therefore purely an example. Thus, the apparatus 10 can have an array of n×m inkjet print heads 11, where n is the number of inkjet print heads arranged next to each other transversely to the printing direction and m is the number of inkjet print heads arranged one behind the other in the printing direction.

In the exemplary embodiment shown in FIG. 1, each of the inkjet print heads 11 has a plurality of ink nozzles, which are arranged next to each other to form a row, and which can be used to direct ink in the form of ink droplets 12 onto a substrate 13 to be printed. The ink nozzles are integrated into a so-called nozzle plate 14 of the inkjet print head, which faces the substrate 13 to be printed.

In addition to the ink nozzles, each of the inkjet print heads 11 also has, according to FIG. 1, two ink ports 15, through which ink can be supplied to each of the inkjet print heads 11. In addition, each of the inkjet print heads 11 has a control terminal 16, designed as an edge connector, where a supply voltage and control signals can be sent via the control terminals to each of the inkjet print heads 11.

The inventive inkjet printing apparatus 10 of FIG. 1 has a print head mounting element 17, which defines the position and thus the orientation of the individual inkjet print heads 11 relative to each other. For this purpose, the print head mounting element 17 has recesses to accept the inkjet print heads 11. The nozzle plates 14 of the inkjet print heads 11 project into these recesses in the print head mounting element 17. A precision stop 18 assigned to the inkjet print head 11 defines the depth to which the inkjet print head 11 can be inserted into the recess of the print head mounting element 17. The precision stop 18 of the inkjet print head 11 comes to rest on the top surface of the print head mounting element 17. As shown in FIG. 1, stops 19 and 20 of the print head mounting element 17 cooperate with the precision stop 18 of inkjet print head 11. The stop 19 of the print head mounting element 17 engages in recesses in the precision stop 18 of the inkjet print head, whereas the stop 20 of the print head mounting element 17 comes to rest laterally against the precision stop 18 of the inkjet print head 11.

Through the interaction between the precision stops 18 of the inkjet print heads 11 and the stops 19 and 20 of the print head mounting elements 17, the inkjet print heads 11 are aligned precisely with respect to each other without the need for complicated readjustments after assembly. This greatly simplifies the handling of the inventive inkjet printing device 10, especially when individual inkjet print heads 11 must be replaced for maintenance or service work.

In addition to the print head mounting element 17, which uniquely defines the relative positions of all the individual inkjet print heads 11 with respect to each other in 3-dimensional space, the inventive inkjet printing device 10 also has a mechanical supply unit 21, which extends across the area of all the inkjet print heads 11, to which the individual ink ports 15 of all the inkjet print heads 11 are connected, and via which all the inkjet print heads 11 can be supplied in common with ink. In the exemplary embodiment of FIG. 1, the mechanical supply unit 21 is in the form of an ink container 22, which holds the ink 23. The ink container 22 is preferably designed as an essentially closed hollow space, which can be formed by two half-shells, for example. The useful volume of the ink container 22 is preferably large enough that a complete printing run can be carried out with the amount of ink which the ink container 22 can hold.

The ink container 22 has several ink openings 24, where, according to FIG. 1, the ports 15 of the inkjet print heads 11 are connected to the ink openings 24 of the ink container 22. To connect the ink openings 24 of the ink container 22 to the ink ports 15 of the inkjet print heads 11, flexible connecting pieces 25 are used, with the help of which the tolerances in the relative positions between the ink ports 15 and the ink openings 24 can be easily and reliably compensated.

Each ink opening 24 of the ink container 22 can be opened and closed by its own separate valve 26, where each of the valves 26 has an actuating mechanism 27, an actuating element 28, and a valve body 29, where the valve body 29 is made of a sealing material resistant to ink. In the exemplary embodiment shown here, the actuating element 28 is designed as a compression spring, which, in the unactuated state of the valve body 29, presses against a valve seat defined by the ink opening 24 and thus closes the corresponding ink opening 24. In an actuated state, however, the valve body 29 is lifted away from the valve seat in opposition to the force of the actuating element 28 and thus releases the corresponding ink opening 24 of the ink container 22, making it possible for ink to flow from the ink container 22 to the corresponding inkjet print head 11.

Via the mechanical supply unit 21, which, in the exemplary embodiment shown here, is designed as an ink container 22, therefore, all of the inkjet print heads 11 can be supplied in common with ink 23. In the simplest case, a single supply line proceeding from an ink reservoir (not shown in FIG. 1) is required to connect the reservoir to the ink container 22 so that ink 23 can be supplied to the ink container 22. There is therefore no need in the inventive inkjet printing device 10 for a plurality of supply lines to supply ink individually to each of the inkjet print heads 11.

The inventive inkjet printing device 10 also has an electric or electronic supply unit 30, which extends over the area of all the inkjet print heads 11. The control terminals 16 of all of the inkjet print heads 11 of the inkjet printing apparatus 10 are connected to the electrical or electronic supply unit 30. By means of the electrical or electronic supply unit 30, all of the inkjet print heads 11 can be supplied in common with a supply voltage and print head-specific control signals.

In the exemplary embodiment of FIG. 1, the electrical or electronic supply unit 30 has a modular design, where a separate control card 31 is provided for each inkjet print head 11. Each control card 31 of each inkjet print head 11 is in electrical contact with the control terminal 16 of the inkjet print head 11 in question. In addition, the control cards 31 of adjacent inkjet print heads 11 are connected to each other by flexible pin-and-socket connectors 32. The control cards 31 of adjacent inkjet print heads 11 are connected to each other in such a way that a kind of bus structure is created, where print head-specific control signals to be transmitted via the bus structure and the supply voltage to be transmitted can be tapped on all sides of the control cards 31. The bus can be designed with a daisy-chain type of structure, for example.

Figure 2:
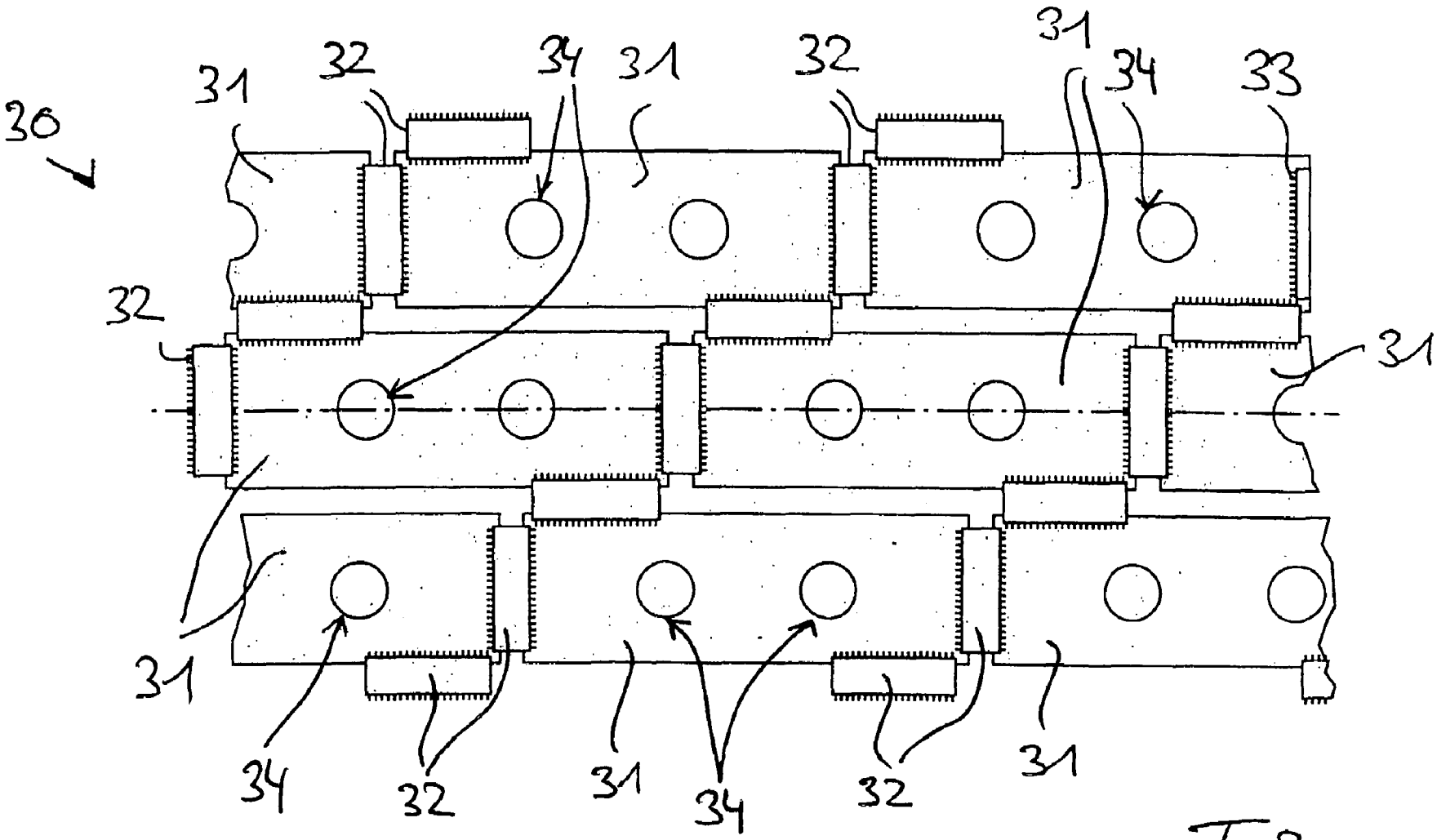
FIG. 2 shows a detail of the inventive inkjet printing apparatus of FIG. 1.

FIG. 2 shows a top view of the electrical or electronic supply unit 30 of the inkjet printing device 10 of FIG. 1, where it can be derived from FIG. 2 that the individual control cards 31 of the inkjet print heads 11 are connected to all of the adjacent control cards 31 of the adjacent inkjet print heads 11 by flexible pin-and-socket connectors 32. A terminating resistor 33 is assigned to one of the control cards 31 to close off the bus structure thus formed at a certain point.

As can be seen in FIG. 2, holes 34 are introduced into the control cards 31, through which, in the assembled state of the inventive inkjet printing device 10 according to FIG. 1, the ink ports 15 of the inkjet print heads extend, so that these ports can be connected to the ink openings 24 of the ink container 22. As can be seen in FIG. 1, the control cards 31 are supported by pin-like mounting elements 35 on the ink container 22 or mechanical supply unit 21 in such a way that mechanical tolerances can be compensated.

Figure 3:
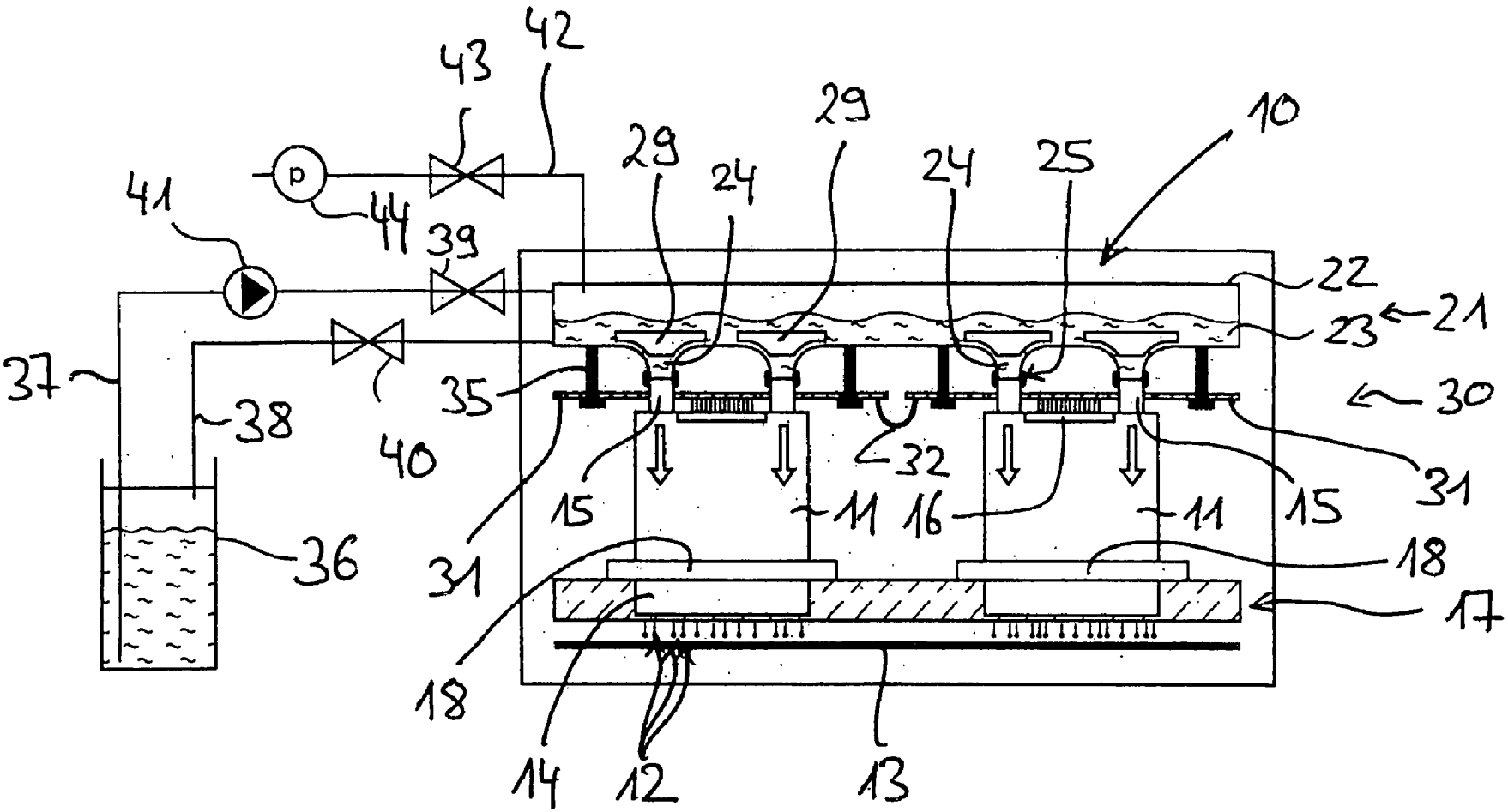
FIG. 3 shows an inventive inkjet printing apparatus similar to the exemplary embodiment of FIGS. 1 and 2 together with a reservoir.

In the exemplary embodiment of FIGS. 1 and 2, all of the ink openings 24 of the ink container 22 of the mechanical supply unit 21 are designed as ink outlets, through which ink can be taken from the ink container 22 and supplied via the ink ports 15 to the inkjet print heads 11. In the exemplary embodiment of FIGS. 1 and 2, the ink 23 is sent by gravity from the ink container 22 to the inkjet print heads 11. The preferred operating mode of an inkjet printing device 10 using gravity is described below with reference to FIG. 3. Thus, FIG. 3 shows an inkjet printing device 10 which is designed like the exemplary embodiment according to FIGS. 1 and 2 but which has a different number of inkjet print heads 11. To avoid unnecessary repetition, therefore, the same reference numbers are used for the same assemblies and reference is made in this respect to the explanations given above.

According to FIG. 3, the ink container 22 of the mechanical supply unit 21 of the inkjet printing device 10 is connected to an ink reservoir 36 by an inflow line 37 and a outflow line 38. Ink is taken from the reservoir 36 via the inflow line 37 and sent to the ink container 22, and ink is taken from the ink container 22 and sent back to the reservoir 36 via the outflow line 38. Valves 39 and 40 are integrated into the inflow line 37 and the outflow line 38, respectively, to close and open the inflow line 37 and the outflow line 38. A pump 41 is also installed in the inflow line 37.

In inkjet printing devices 10 of this type, in which the ink 23 is sent from the ink container 22 under the effect of gravity to the inkjet print heads 11, the problem frequently occurs that the function of the print heads is impaired by the accumulation of very small gas bubbles in the ink nozzles of the inkjet print heads. This situation remains in effect until the inkjet print head 11 can be vented.

One of the causes of these tiny gas bubbles is the presence of highly volatile components in the ink, which out-gas as a result of so-called cavitation effects attributable to the negative and positive pressures which occur during the actual inkjet printing process. During the printing operation, these gas bubbles collect in the ink nozzles of the inkjet print heads. To counteract this effect, the ink container 22 of the mechanical supply unit can be degassed by way of a vacuum line 42 connected to the supply unit; a valve 43 and a pump 44 are integrated into this line. To degas the ink 23 or the ink container 22, the valves 39 and 40 of the inflow line 37 and outflow line 38 are closed, and all the valves 29 assigned to the ink openings 24 of the ink container 22 are also closed. Then, a defined negative pressure is applied via the vacuum line 42 to the ink container 22 to degas the ink. Then, in succession, each valve 29 is opened for a short time until the volume of freshly degassed ink present in the inkjet print head in question has been displaced. Then it is possible, with a high degree of reliability, to print continuously and uninterruptedly for a relatively long period of time without the danger of blockage of the inkjet print heads by accumulations of gas bubbles.

Figure 4:
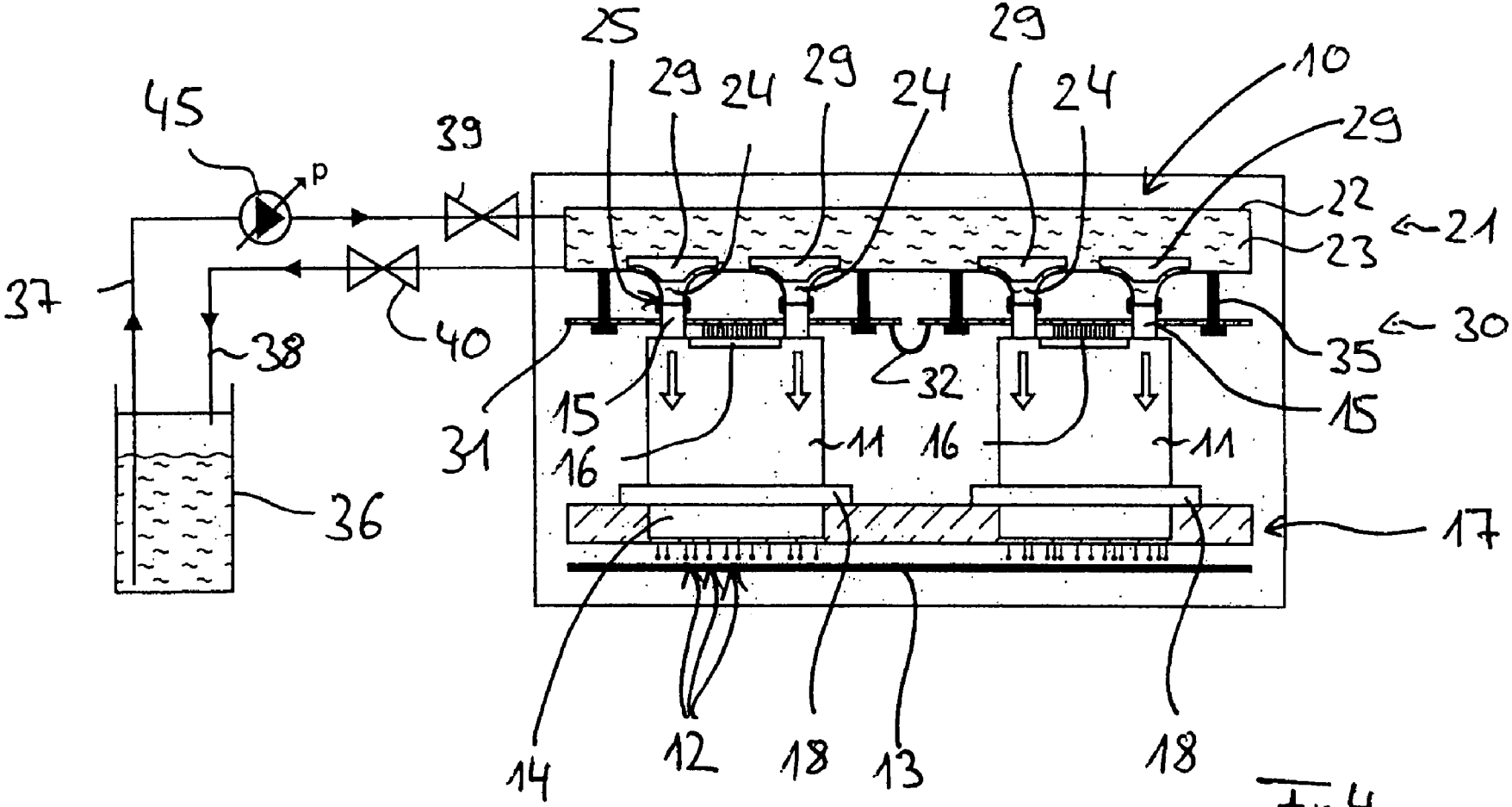
FIG. 4 shows another inventive inkjet printing device similar to the exemplary embodiment of FIGS. 1 and 2 together with a reservoir.

FIG. 4 shows an operating mode of the inkjet printing device 10 in which, in contrast to the exemplary embodiment of FIG. 3, the ink 23 is taken from the ink container 22 not by the force of gravity but rather by the use of a circulating ink supply system. In the exemplary embodiment of FIG. 4, the ink container 22 is connected by two lines to the ink reservoir 36, i.e., again by an inflow line 37 and an outflow line 38, where the inflow line 37 forms here a feed line and the outflow line 38 forms a return line. Here again, valves 39, 40 are integrated into the feed line 37 and the return line 38 to open and close the lines 37, 38.

According to FIG. 4, a controllable pump 45 is integrated into the inflow line or feed line 37; the circulating ink supply of the ink container 22 and thus the pressure in the ink container 22 can be regulated by means of this pump. The inkjet printing apparatus 10 works together with the reservoir 36 to form a closed circuit, from which the individual inkjet print heads 11 can be supplied with ink.

Common to the exemplary embodiments illustrated in FIGS. 1-4 is that ink is supplied to all of the inkjet print heads 11 together exclusively in accordance with the so-called "end shooter" principle without the possibility of circulation within the inkjet print head 11. This means that, once ink has entered the inkjet print head 11 of the exemplary embodiments according to FIGS. 1-4, this ink can leave the print head only through the ink nozzles.

Figure 5:
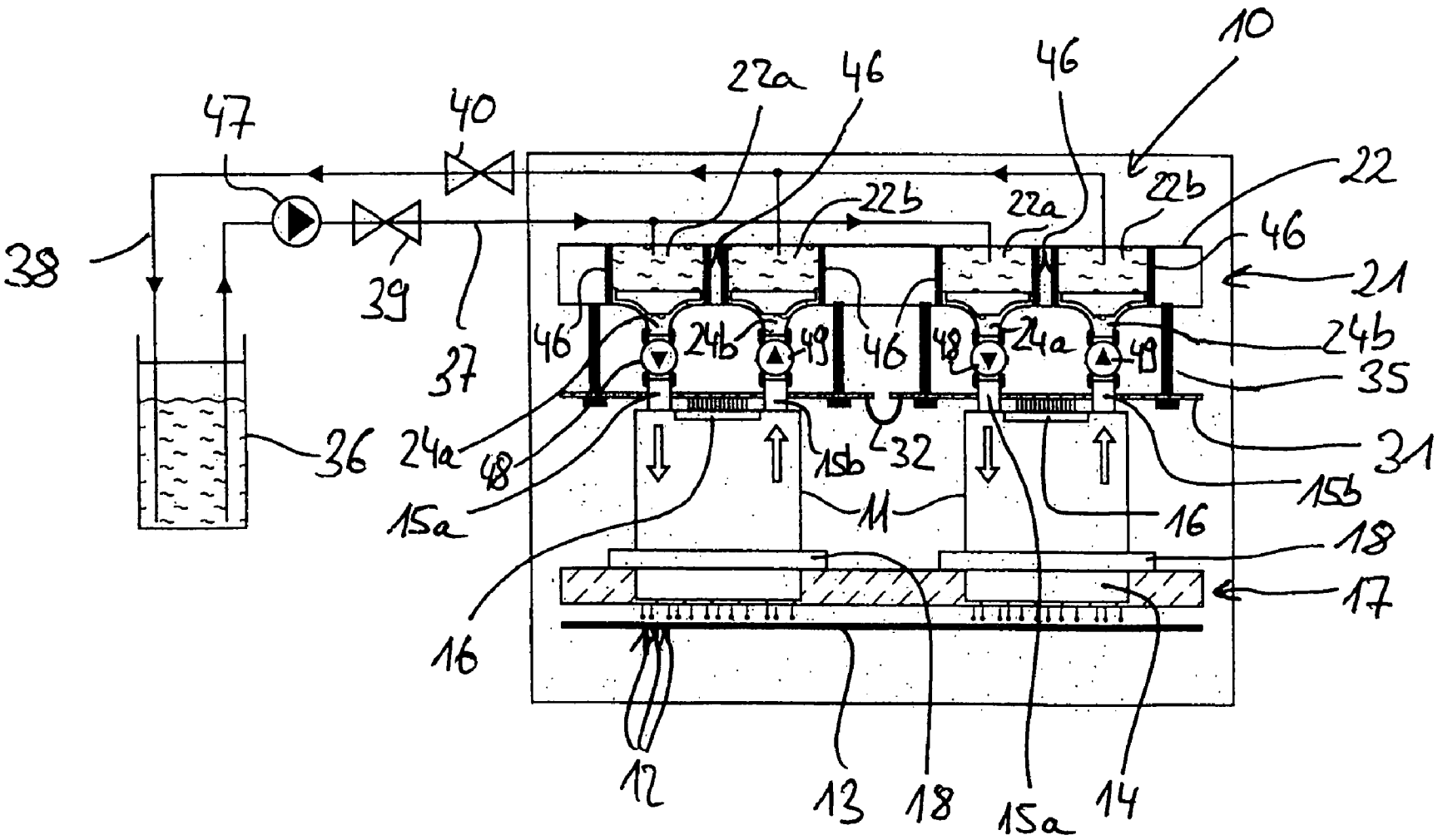
FIG. 5 shows another inventive inkjet printing device together with a reservoir.

In contrast, FIG. 5 shows an exemplary embodiment of an inkjet printing apparatus 10 in which the inkjet print heads 11 have the possibility of internal ink circulation. A first set of ink ports 15 is accordingly designed as ink feed ports 15*a*, and a second set of ink ports is designed as ink return ports 15*b*. Ink can thus be supplied to the inkjet print heads 11 via the ink feed ports 15*a*, whereas ink can be discharged from the inkjet print heads 11 via the ink return ports 15*b*. Accordingly, first ink openings 24 of the ink container 22 are designed as ink outlets 24*a*, and second ink openings 24 are designed as ink inlets 24*b*, where the ink outlets 24*a* of the ink container 22 of the mechanical supply unit 21 are connected to the ink feed ports 15*a* of the inkjet print heads 11, and the ink inlets 24*b* of the ink container 22 are connected to the ink return ports 15*b* of the inkjet print heads 11. Such inkjet print heads with the possibility of ink circulation are also called "side shooters".

In the exemplary embodiment of FIG. 5, the ink container 22 is divided by partitions 46 into feed containers 22*a* and return containers 22*b*, where the ink outlets 24*a* are assigned to the feed containers 22*a*, and the ink inlets 24*b* are assigned to the return containers 22*b* of the ink container 22. According to FIG. 5, all of the feed containers 22*a* of the ink container 22 are connected by an inflow line 37 to an ink reservoir 36, whereas the return containers 22*b* are connected by a return line 38 to the reservoir 36. In the exemplary embodiment according to FIG. 5, therefore, the inflow line 37 is again designed as a feed line and the outflow line 38 as a return line. Valves 39 and 40 are again integrated in the two lines 37 and 38 so that the lines can be opened and closed. According to FIG. 5, a pump 47 is again integrated into the inflow line 37 serving as the feed line. This pump is used to maintain the continuously circulating ink supply of the inkjet print heads 11.

As can be derived from FIG. 5, pumps 48 and 49 are also integrated into the inkjet print head 11, one of them being installed between the ink outlet 24*a* and ink feed port 15*a*, the other between the ink inlet 24*b* and the ink return port 15*b*.These pumps are used to support the circulation of the ink. Under certain conditions, it may also be possible to omit the pumps 48 and/or the pumps 49.

Figure 6:
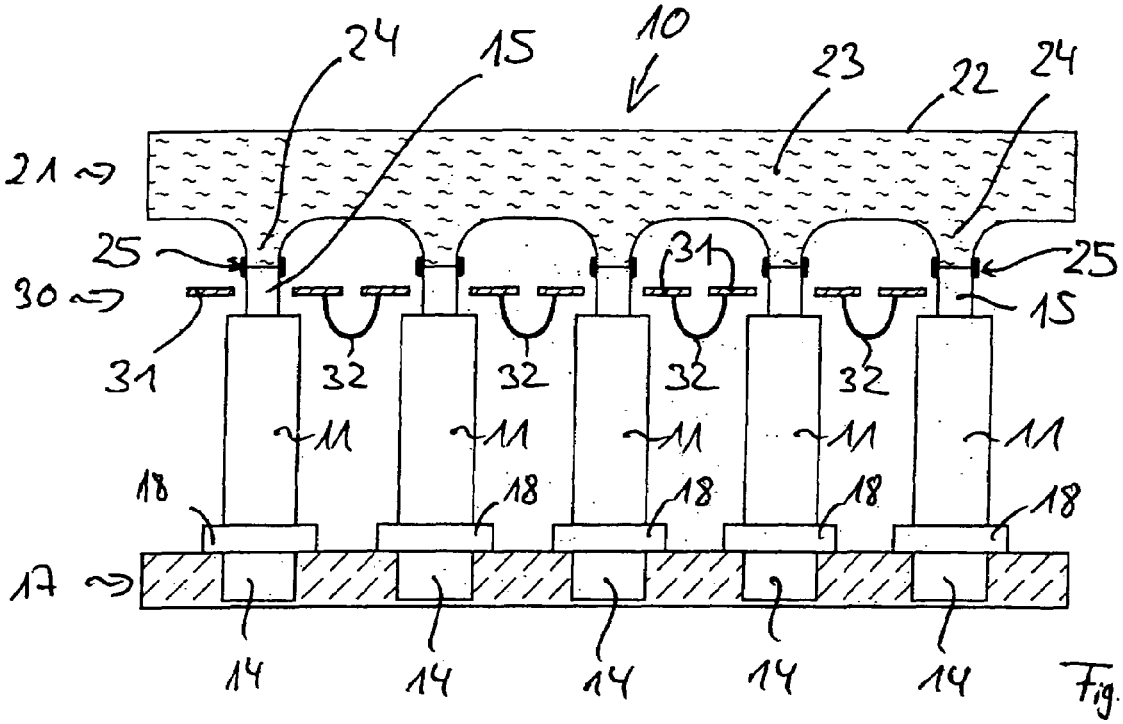
FIG. 6 shows another inventive inkjet printing device.

FIG. 6 shows a schematic diagram of an inventive inkjet printing apparatus 10, which is designed like the exemplary embodiment of FIGS. 1 and 2 and which has five inkjet print heads 11 positioned one behind the other in the printing direction. The print head mounting element 17 is designed like the print head mounting element 17 of the exemplary embodiment of FIGS. 1-5 as a flat, plate-shaped mounting element and is configured in such a way that all of the inkjet print heads 11, that is, the nozzle plates 14 of the print heads, are all approximately the same distance away from the substrate to be printed in cases where the substrate is guided along a flat path.

An inkjet printing apparatus 10 of this type is useful especially in cases where it is to be integrated into an offset printing press at a point where the substrate is flat and is therefore being carried along without curvature. This can be in the area of a delivery unit, for example, or in the area of a slanted paper web lead.

Figure 7:
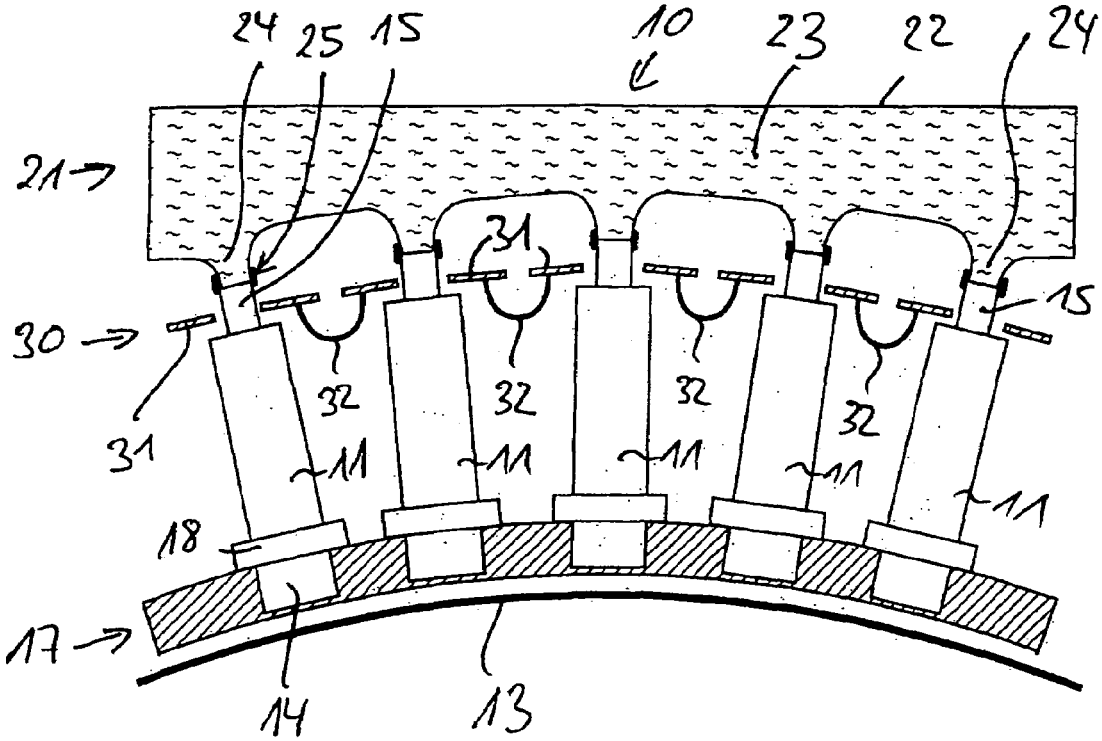
FIG. 7 shows another inventive inkjet printing device.

In contrast, it is also possible, as can be derived from FIG. 7, to design the print head mounting element 17 as a curved, plate-shaped mounting element. All of the inkjet print heads 11, namely, the nozzle plates 14 of the print heads, are approximately the same distance away from the substrate to be printed in cases where the substrate is carried along a curved path.

Common to all of the inkjet printing devices shown in FIGS. 1-7 is that they are constructed on essentially three different planes. A first plane is defined by the print head mounting element 17, which holds the individual inkjet print heads and uniquely defines the position of the print heads relative to each other in 3-dimensional space. A second plane is defined by the mechanical supply unit 21, which serves to supply the inkjet print heads with ink. A third plane, which lies between the first plane and the second plane, is defined by the electrical or electronic supply unit 30, which supplies the individual inkjet print heads with control signals and also with a supply voltage. The mechanical supply unit 21 and the electrical or electronic supply unit 30 extend over the area of all the inkjet print heads and serve to supply all of them in common. As a result, there is no need to install separate supply lines to each individual inkjet print head. Instead, it is sufficient to connect the mechanical supply unit 21 to an ink reservoir and to connect the electrical or electronic supply unit 30 to a control unit and voltage supply source by a minimum number of lines. This simplifies the management of the inkjet printing units.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An inkjet printing apparatus comprising:

an array of inkjet print heads, each print head comprising at least one ink port for receiving ink, at least one nozzle for directing ink onto a substrate to be printed, and at least one control terminal for receiving at least one of a supply voltage and control signals;

a print head mounting element which positions the print heads in a defined orientation relative to each other;

an electrical supply unit extending over the array and connected to the control terminals of all of said print heads, wherein said electrical supply unit can supply said at least one of a supply voltage and control signals to all of said print heads in common; and a mechanical supply unit extending over the array and connected to the ink ports of all of said print heads, wherein said mechanical supply unit can supply ink to all of said print heads in common.

2. The inkjet printing apparatus of claim 1 wherein the electrical supply unit is of modular design and comprises a separate control card for each said print head, each said control card being connected to a control terminal of a respective said print head, the control cards of adjacent said print heads being connected to each other.

3. The inkjet printing apparatus of claim 2 wherein the control cards of adjacent said print heads are connected to each other to form a bus structure, each said control card having a plurality of sides from which said at least one of a supply voltage and control signals can be tapped for transmission to an adjacent control card.

4. The inkjet printing apparatus of claim 3 wherein said control cards of adjacent said print heads are connected to each other by flexible pin-and-socket connectors.

5. The inkjet printing apparatus of claim 1 further comprising a supply cable connecting said electrical supply unit to a control unit and a voltage source.

6. The inkjet printing apparatus of claim 1 wherein the mechanical supply unit comprises an ink container having openings connected to respective said ink ports, each said opening having a valve which can be opened and closed independently of other said valves.

7. The inkjet printing apparatus of claim 6 further comprising an ink reservoir connected to the ink container by an inflow line and an outflow line.

8. The inkjet printing apparatus of claim 6 further comprising flexible connecting pieces connecting respective said openings to respective said ink ports.

9. The inkjet printing apparatus of claim 6 further comprising partitions dividing the ink container into at least one feed container having ink outlets and at least one return container having ink inlets, said ink outlets being connected to respective said ink ports of said print heads, said ink inlets being connected to respective said openings of said ink container.

10. The inkjet printing apparatus according to claim 6 wherein the ink is supplied from the ink container to the print heads by gravity, the apparatus further comprising a vacuum line for degassing the ink container.

11. The inkjet printing apparatus of claim 6 further comprising an ink circulation system for supplying ink from the ink container to the print heads.

12. The inkjet printing apparatus of claim 1 wherein the print head mounting element is a flat plate designed so that all the print heads are the same distance from a substrate to be printed, wherein the substrate is carried on a flat path parallel to the plate.

13. The inkjet printing apparatus of claim 1 wherein the print head mounting element is a curved plate designed so that all the print heads are approximately the same distance from a substrate to be printed, wherein the substrate is carried on a curved path parallel to the plate.

14. The inkjet printing apparatus of claim 1 wherein the print head mounting element has recesses which receive respective said inkjet print heads, and stops adjacent to said recesses, wherein said stops define the orientation of the print heads relative to each other.

* * * * *